United States Patent [19]

Satterfield

[11] 4,162,752

[45] Jul. 31, 1979

[54] ROTATING DRUM SPREADER

[75] Inventor: Larry S. Satterfield, Spartanburg, S.C.

[73] Assignee: Milliken Research Corporation, Spartanburg, S.C.

[21] Appl. No.: 812,699

[22] Filed: Jul. 5, 1977

[51] Int. Cl.[2] ..... B07B 1/24

[52] U.S. Cl. ..... 222/342; 222/616; 209/293

[58] Field of Search ..... 222/167, 614, 620, 624, 222/625, 414, 342, 189, 406, 407, 616; 209/293, 288

[56] References Cited

U.S. PATENT DOCUMENTS

| | | | |
|---|---|---|---|
| 1,837,782 | 12/1931 | Little | 209/293 |
| 2,546,702 | 3/1951 | Ready | 222/616 |
| 3,007,576 | 11/1961 | Hannaford | 209/288 |
| 3,545,875 | 12/1970 | Schneider | 401/197 |
| 4,040,948 | 8/1977 | Hergeth et al. | 209/293 |

FOREIGN PATENT DOCUMENTS

| | | | |
|---|---|---|---|
| 1293603 | 10/1972 | United Kingdom | 222/406 |

*Primary Examiner*—Stanley H. Tollberg
*Attorney, Agent, or Firm*—H. William Petry

[57] ABSTRACT

A powder dispensing device having a powder storage bin with a powder discharge area, a perforated drum rotatably mounted within the bin adjacent to the powder discharge area and a wiper blade mounted within the drum and engaging the interior surface of the drum near the powder discharge area.

7 Claims, 6 Drawing Figures

ROTATING DRUM SPREADER

It seems that the entire country will soon be covered with wall-to-wall carpeting, which now covers vast areas while hardwood and vinyl asbestos floors are found only in hopelessly dated structures. Kitchens, bathrooms, even porches have their own special carpets. Stores and businesses must display wide expanses of carpet if they are to attract today's increasingly decor-conscious consumers who not only demand carpet but are quick to spend elsewhere if the carpet is not kept scrupulously clean. Since maintenance of these large areas of carpet is often difficult and always expensive, the carpet cleaning industry is constantly seeking new and improved methods for cleaning carpet. Methods such as steam extraction and shampooing are commonly used by these methods are best employed after hours because they are disruptive. Recently, a radically new method of cleaning has been developed which uses a powdered cleaning composition of the type described in U.S. Pat. No. 4,013,594. Using this method, it is possible to clean carpets during working hours while causing only minimal interference with normal business affairs. However, this powdered cleaning composition has proved to be difficult to economically apply to large areas of carpets because it is coherent, that is, the particles of the cleaning composition tend to adhere to each other. When those devices, which are commonly known to the prior art for dispensing powders, are used for dispensing coherent powders, at best, they spread the powder unevenly and, most often, intermittently. Further, it has been found that these devices tend to dispense coherent powders at varying rates depending upon the moisture content of the powder. One device which has proved successful in spreading coherent powders is described in U.S. Pat. No. 4,019,662. However, this device uses a reticulated foam roller which wears out and is expensive to replace. Further, to dispense powder at a rate which is satisfactory for carpet cleaning requires that the reticulated foam roller rotate rather quickly. Rotating the cylinder at these speeds requires more power than is easily developed by an operator pushing the device across a carpet, thus an expensive auxiliary motor is highly desirable with this device.

It is therefore an object of this invention to provide a device for dispensing coherent powders evenly at a rate which is relatively independent of the moisture content of the powder and which is durable and inexpensive.

It is another object of this invention to provide a device which can be driven from the wheels as the device is translated over the carpet.

It has been found that these objects may be achieved by providing a device having a powder storage bin with a discharge area and a rotatable foraminous drum disposed within the powder storage bin adjacent to the discharge area and a flexible wiper blade mounted within the rotating drum which engages the interior of the rotating drum near the powder discharge area.

DETAILED DESCRIPTION OF THE PREFERRED EMBODIMENT

Figure 1:
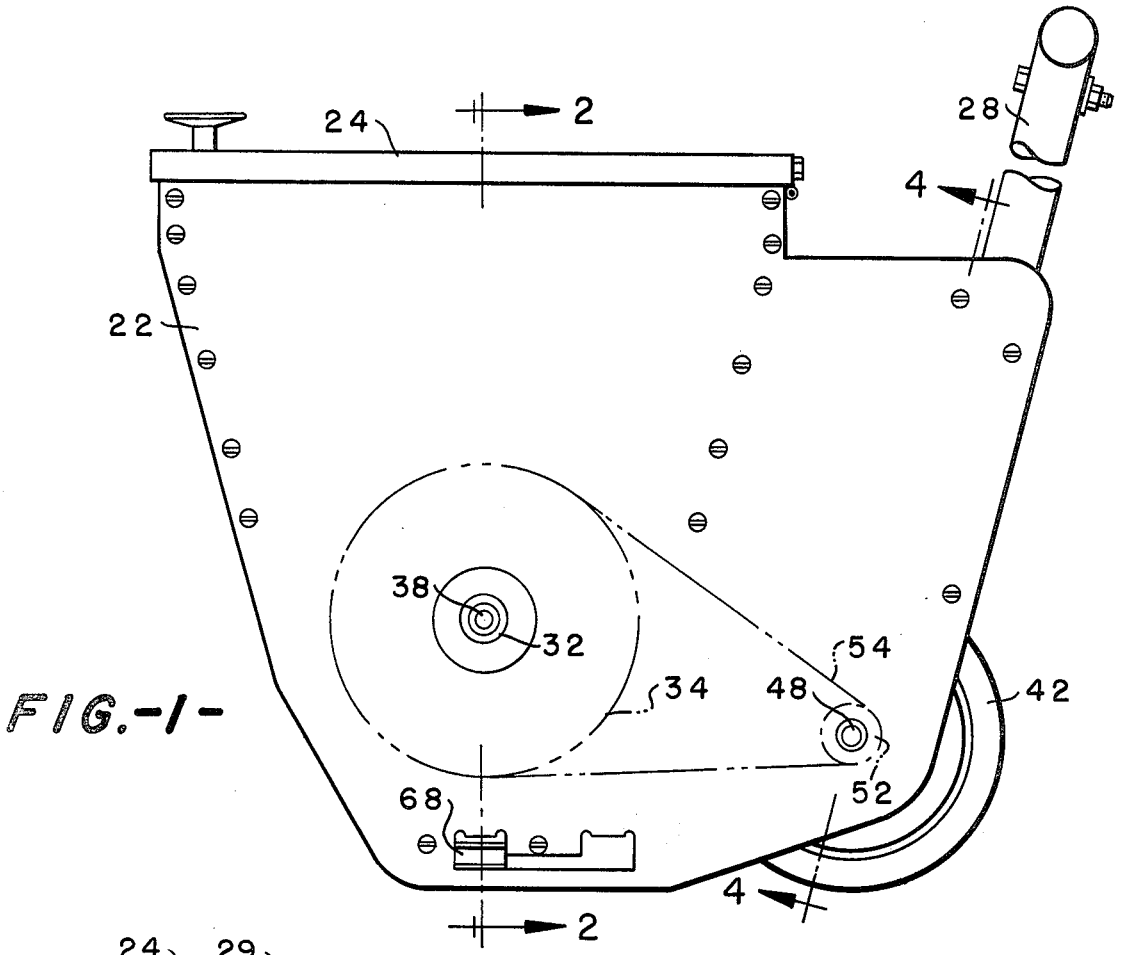
FIG. 1 is a schematic right side elevation view of the device of this invention.
Figure 2:
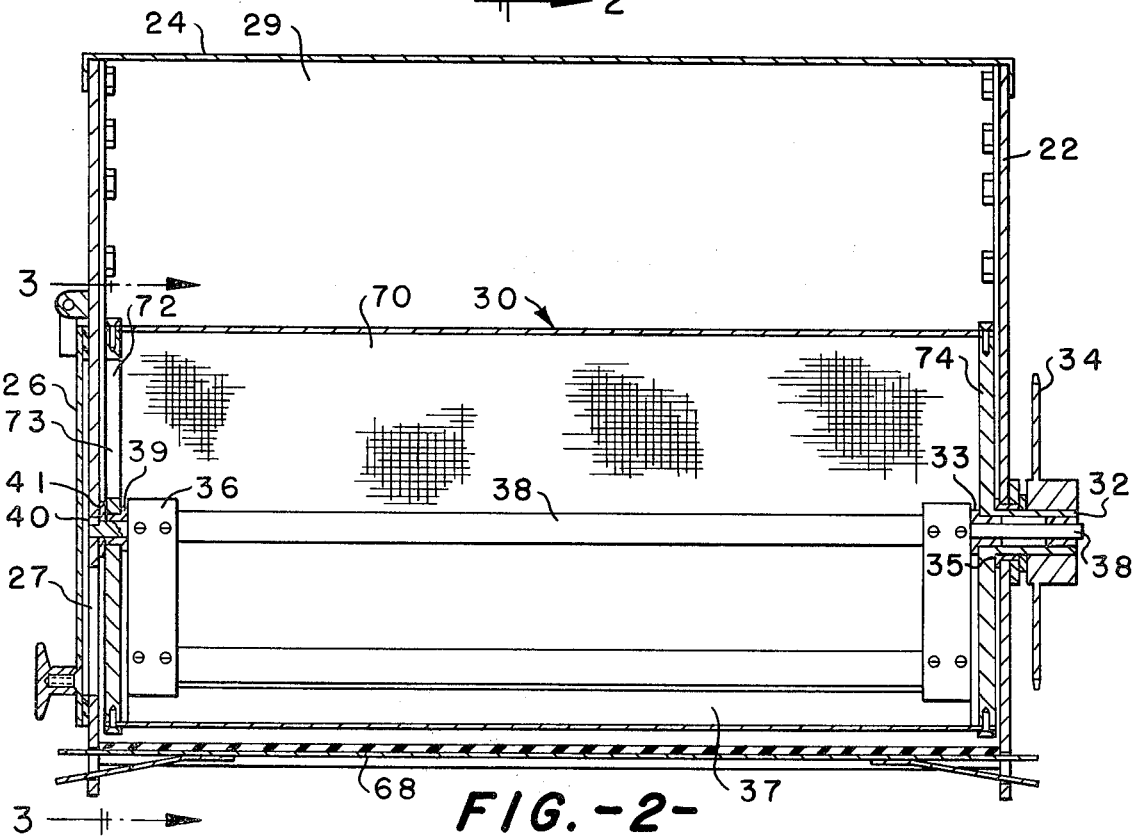
FIG. 2 is a sectional view taken along line 2—2 in FIG. 1.
Figure 3:
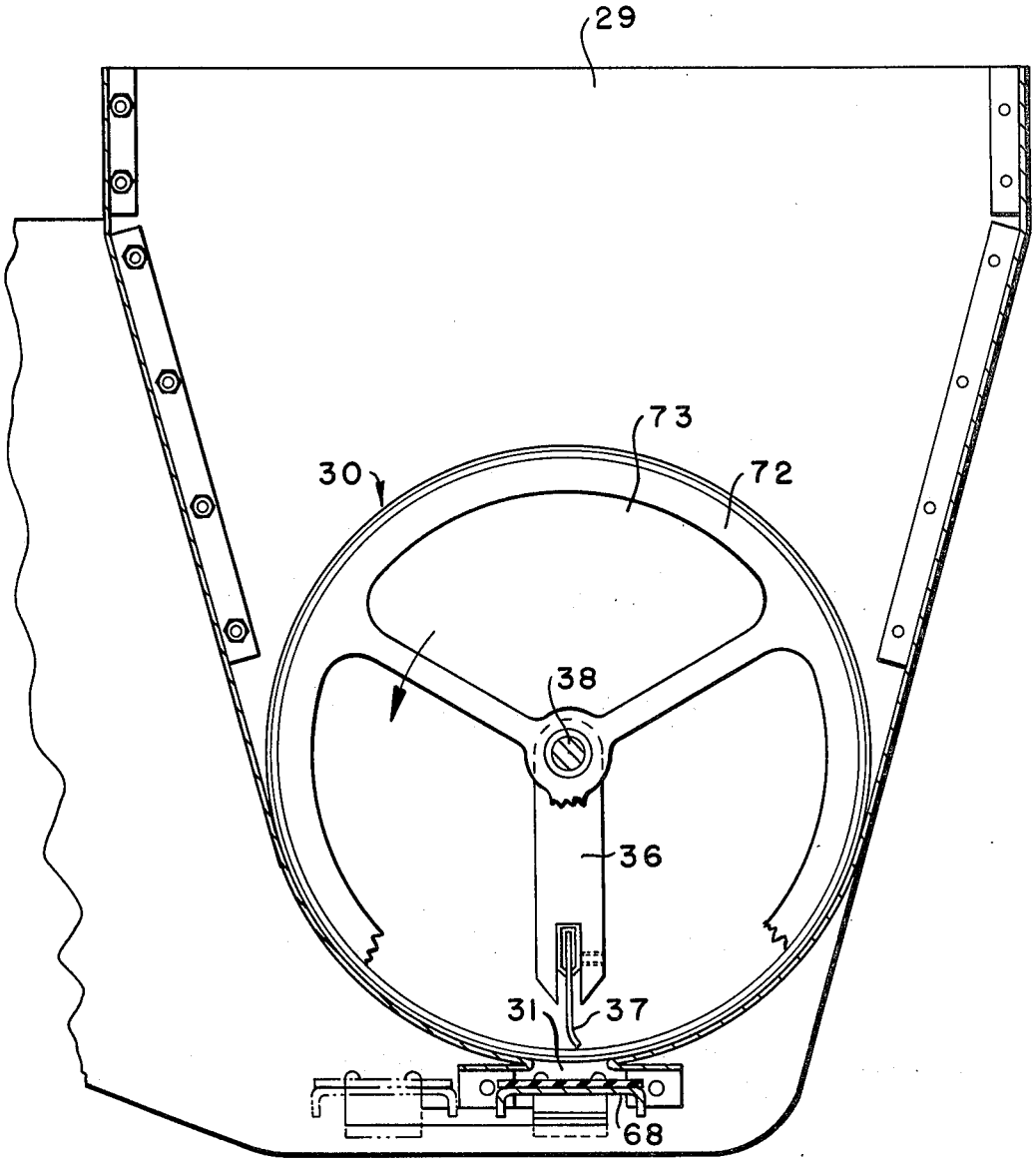
FIG. 3 is a sectional view taken along line 3—3 of FIG. 2.

As shown in FIG. 1, the device comprises a housing 22 having a cover 24 as one means of introducing powder into the device and a handle 28 attached to the housing 22. As shown in FIG. 2 and 3, powder storage bin 29 is formed within housing 22 and drum 30 is rotatably mounted within powder storage bin 29 in close proximity to powder discharge slot 31 which extends substantially across the width of powder storage bin 29.

The peripheral surface to drum 30 is foraminous or perforated and preferably is formed from rigid woven wire screen. However, it may be advantageous to use another layer of larger mesh rigid wire screen placed around the periphery of the smaller mesh woven wire screen to provide additional stiffness to the drum. In the most preferred embodiment, drum 30 will be formed as shown in FIG. 2 from a screen 70 which is fastened to the edges of support discs 72 and 74 to form a right circular cylinder.

Advantageously, one of the support discs (preferably 72) will have cutout portions 73 to provide a means for introducing powder directly into the drum and through which wiper blade support 36 and wiper blade 37 may be adjusted. To facilitate access to the interior of the drum, side door 26 covers aperture 27 formed in housing 22 adjacent to the cutout portions 73 of disc 72. Wiper blade support 36 is rigidly mounted within rotating drum 30 and supports flexible wiper blade 37 which engages the interior of drum 30 closely adjacent to powder discharge slot 31 and forces powder through the foramina in drum 30. As can be seen in FIGS. 2 and 3, wiper blade 37 engages the interior of drum 30 continuously across the width of powder discharge slot 31. Support disc 74 is fixed to hollow shaft 32 which passes through bushing 35 mounted in the side wall of housing 22. Bushing 33 is mounted on the interior of support disc 74 and protrudes into hollow shaft 32. Sprocket 34 is attached to the end of hollow shaft 32 on the exterior of housing 22, while wiper blade support 36 is mounted upon solid shaft 38 which passes through bushing 33 mounted in support disc 74, hollow shaft 32, the interior of drum 30, bushing 39, thrust washer 41 and then engages housing 22 where key 40 prevents it from rotating. Thrust washer 41 is disposed between support disc 72 and housing 22 to facilitate rotation of drum 30. Advantageously, drum 30 may be rotated by the motion of the device as it is translated.

Figure 5:
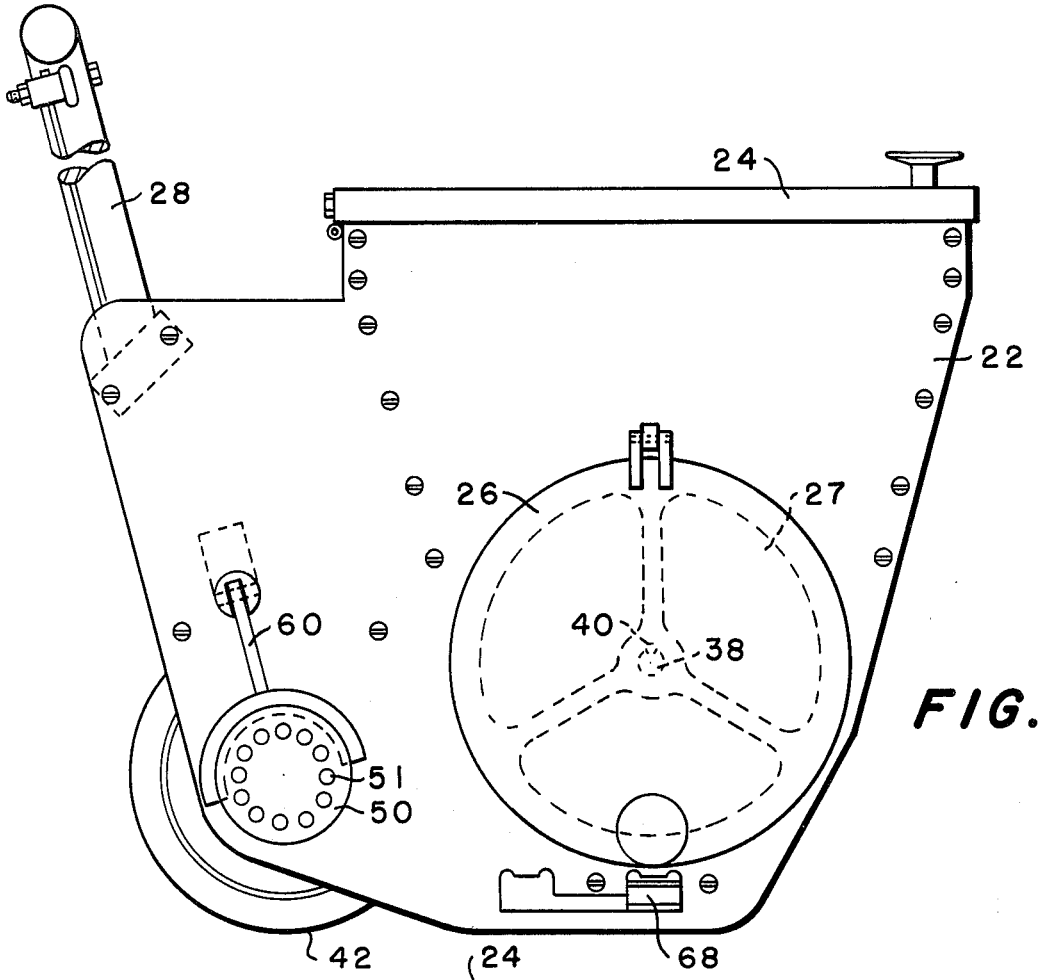
FIG. 5 is a side elevation showing the left side of the device of the present invention.
Figure 4:
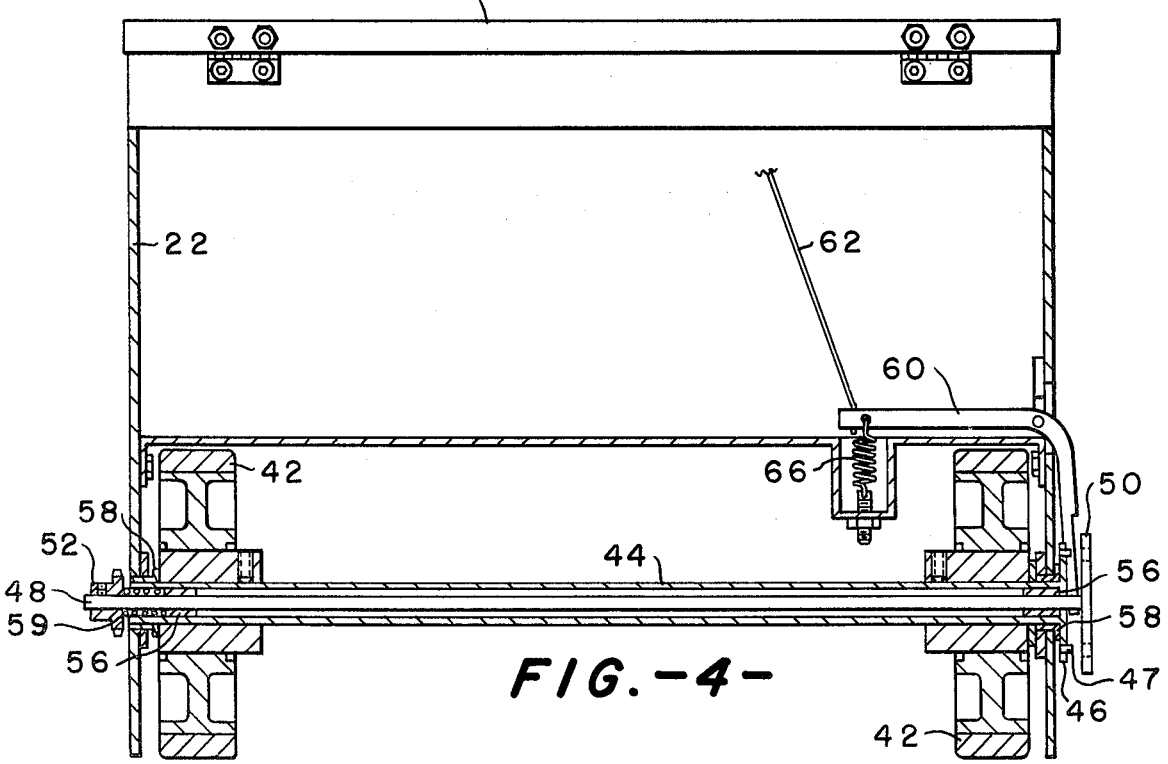
FIG. 4 is a sectional view taken along line 4—4 of FIG. 1.
Figure 6:
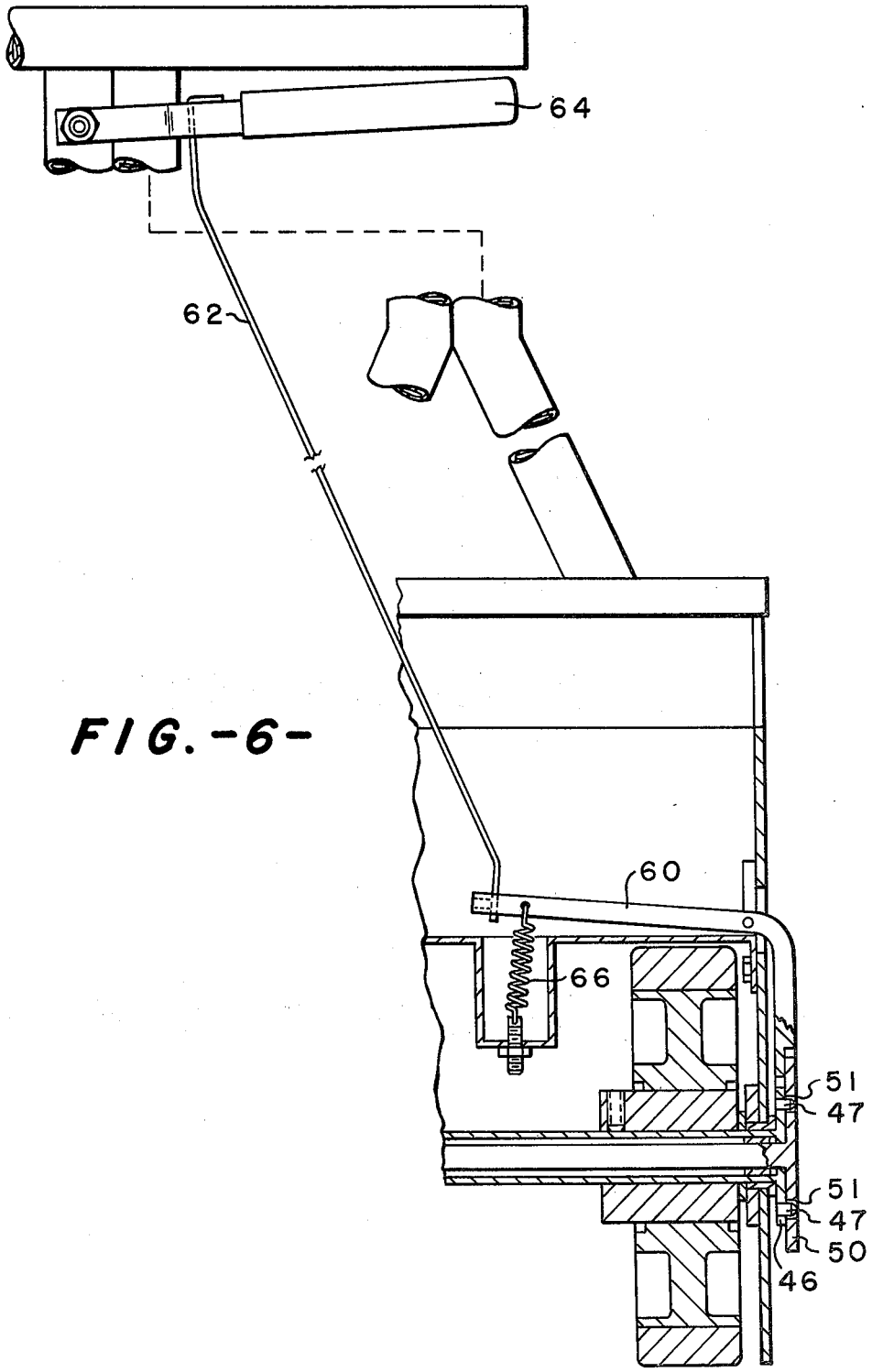
FIG. 6 is schematic partly sectional fragmentary rear elevation showing the disengaging device by which means for driving the drum may be disengaged from the rear wheels.

As best shown in FIGS. 4 and 5, wheels 42 are mounted on hollow shaft 44 which is supported by bushings 58 in housing 22. Drive disc 46 is mounted on one end of hollow shaft 44 and has pins 47 protruding from it. Solid shaft 48 is rotatably supported within hollow shaft 44 by bushings 56 and drive disc 50 with holes 51 is mounted on one end of solid shaft 48 and sprocket 52 is mounted on the other end of the solid shaft. As best shown in FIG. 1, chain or other suitable drive means 54 engages sprockets 52 mounted on solid shaft 48 and also engages sprocket 34 mounted upon hollow shaft 32. Upon rotation of wheels 42, hollow shaft 44 will also rotate. If disc 50 is held in engagement with disc 46, then solid shaft 48 will be rotated also, whereupon drum 30 will be rotated. As shown in FIG. 6, drum 30 is caused to rotate only when actuating handle 64 is pulled upwards, causing actuating rod 62 to pivot actuating lever 60 clockwise. Biasing means such as spring 66 normally urges actuating lever 60 in a counterclockwise direction preventing disc 50 from engaging disc 46 but when actuating lever 60 is pivoted clockwise, spring 59 between bushing 56 and sprocket 57 urges shaft 48 to the left allowing pins 47 on disc 46 to engage holes 51 on disc 50. Advantageously, door 68 is provided under the discharge slot for preventing the release of powder when so desired.

I claim:

1. A device for dispensing powder on a surface, comprising:

housing means forming a powder storage bin having a powder discharge slot formed therein, said slot extending substantially across the width of said powder storage bin;

a drum having a foraminous peripheral surface;

means for rotatably mounting said drum within said powder storage bin;

a stationary wiper blade means for forcing powder through the foramina in said drum;

means for mounting said wiper blade within said drum and for maintaining said wiper blade in engagement with the interior of the peripheral surface of said drum in close proximity to said powder discharge slot, said wiper blade engaging the interior of the peripheral surface of said drum continuously across the width of said powder discharge slot; and means for rotating said drum.

2. The device of claim 1, wherein the means for mounting the wiper blade includes a first shaft member passing through one end of said drum and engaging the interior of said housing means.

3. The device of claim 2, wherein said drum comprises:

two disc members; and a wire screen extending between and engaging the edges of both discs.

4. The device of claim 3, further comprising:

an axle rotatably mounted on said housing means;

a pair of wheels mounted on said axle; and wherein the means for rotating the drum comprises:

a second shaft attached to one of said disc members, extending from the interior to the exterior of said housing means and means for driving said second shaft in response to rotation of said wheels.

5. The device of claim 4, wherein said axle is hollow and wherein the means for driving said second shaft in response to rotation of said wheels includes:

a third shaft disposed within said axle;

clutch means disposed at one end of said axle for coupling and decoupling said third shaft and said axle; and means for rotating said second shaft in response to rotation of said third shaft.

6. The device of claim 5 wherein said clutch means includes:

a first plate member mounted on said axle having an aperture therethrough, said aperture encircling said third shaft;

a second plate member mounted on said third shaft adjacent to said first plate member; and means for urging said first plate member into engagement with said second plate member.

7. A device for dispensing powder on a surface, comprising:

housing means forming a powder storage bin, having a powder discharge slot formed therein, said powder discharge slot extending substantially across the width of said powder storage bin;

a first disc having a substantially circular aperture therethrough;

a second disc having a substantially circular aperture therethrough;

a first shaft member, having a cylindrical void, attached to said second disc, the centerline of said cylindrical void substantially coinciding with the center of said aperture in said second disc; said first shaft member extending from the interior to the exterior of said housing means;

a foraminous cylindrical wall member extending between the edge of said first disc and the edge of said second disc;

a second shaft fixed to the interior of said housing means, passing through the aperture in said first disc, passing through the aperture in said second disc, and rotatably supported within said cylindrical void in said first shaft member;

a stationary wiper blade means for forcing powder through the foramina in said drum mounted on said second shaft, engaging the interior of said cylindrical foraminous wall member adjacent to said powder discharge slot continuously across the width of said powder discharge slot; and means for rotating said first shaft.

* * * * *